United States Patent [19]

Menjo et al.

[11] Patent Number: 4,500,633

[45] Date of Patent: Feb. 19, 1985

[54] SILVER HALIDE PHOTOGRAPHIC MATERIAL

[75] Inventors: Hiroshi Menjo, Hachioji; Yoshikazu Watanabe, Akishima, both of Japan

[73] Assignee: Konishiroku Photo Industry Co., Ltd., Japan

[21] Appl. No.: 466,590

[22] Filed: Feb. 15, 1983

[30] Foreign Application Priority Data

Feb. 15, 1982 [JP] Japan ..... 57/23296

[51] Int. Cl.[3] ..... G03C 1/46

[52] U.S. Cl. ..... 430/505; 430/506; 430/508; 430/509; 430/544; 430/957

[58] Field of Search ..... 430/505, 506, 508, 509, 430/544, 957

[56] References Cited

U.S. PATENT DOCUMENTS

| | | | |
|---|---|---|---|
| 3,620,747 | 11/1971 | Marchant et al. | 430/509 |
| 4,184,876 | 1/1980 | Eeles et al. | 430/505 |
| 4,248,962 | 2/1981 | Lau | 430/544 |
| 4,267,264 | 5/1981 | Lohmann et al. | 430/505 |
| 4,355,100 | 10/1982 | Sugita et al. | 430/505 |
| 4,409,323 | 10/1983 | Sato et al. | 430/957 |

*Primary Examiner*—J. Travis Brown

*Attorney, Agent, or Firm*—Jordan B. Bierman

[57] ABSTRACT

A silver halide photographic material having formed on a support two or more layers that have different light sensitivities but have substantially the same color sensitivity is disclosed. In the material, the layer having the highest light sensitivity contains only a compound of formula (I) as a DIR compound and at least one of the remaining layers contains at least one compound of formula (II) as a DIR compound:

A—TIME—Z (I)

A—Z (II)

wherein A is a coupling component capable of reaction with the oxidized product of a color developing agent to release the group TIME—Z (wherein TIME represents a timing group and Z represents a development retarder). The photographic material has improved sharpness and granularity and wide latitude for exposure.

8 Claims, No Drawings

SILVER HALIDE PHOTOGRAPHIC MATERIAL

FIELD OF THE INVENTION

The present invention relates to a silver halide photographic material having two or more layers that are sensitive to substantially the same spectral region and have different light sensitivity (such material is hereunder referred to as a multi-layer photosensitive material). More particularly, the invention relates to a new multi-layer photosensitive material having improved sharpness and granularity and wide latitude for exposure.

BACKGROUND OF THE INVENTION

In a well known photographic process, a multi-layer photosensitive material comprising a support coated with a coupler-containing silver halide emulsion is developed with a color developer containing an aromatic amine derivative to form an image. The image formed on multi-layer photosensitive materials must have two important characteristics. One of them is good sharpness (the image has a sharp contour which is not impaired when the image is very small) and the other characteristic is a wide latitude for exposure (in particular, a negative photosensitive material must have high reproducibility over a wide range of exposure). Various attempts have been made to produce multi-layer photosensitive materials having these characteristics, but none of them have been completely satisfactory.

It is well known that the sharpness of an image is increased by adjacency effect. This effect makes use of the gradient of the concentration of a retardant during development and is realized by diluting the developer with water or by gentle stirring. A particularly effective method is to incorporate in the photosensitive material a compound that releases a retardant upon reaction with the oxidized developing agent. Examples of such compound are DIR couplers of the type described in U.S. Pat. Nos. 3,148,062 and 3,227,554 which couple with the oxidized color developing agent to form a dye and release the development retarder, as well as DIR materials of the type described in U.S. Pat. No. 3,632,345 which couple with the oxidized color developing agent to release the development retarder without forming a dye. The DIR coupler and DIR material are hereunder collectively referred to as a DIR compound.

Japanese Patent Application O.P.I. Publication No. 145135/79 (the symbol OPI as used herein is an abbreviation of "Open to Public Inspection" describes a DIR compound that reacts with the oxidized product of a color developing agent to release a split-off compound through intramolecular nucleophilic substitution reaction. Japanese Patent Application No. 17644/80 describes a DIR compound that indirectly releases a retarder by means of electron transfer along a conjugated chain. With these compounds, the effect of the retarder is exhibited at a position spaced by a certain distance from the developed silver halide grains, and the color purity is greatly improved because of "interlayer effect". The sharpness is also increased due to adjacency effect, but no remarkable improvement in granularity is obtained.

Multi-layer photosensitive materials having wide latitude for exposure are already known and they are prepared by coating a support with a high-sensitivity silver halide emulsion layer and a low-density silver halide emulsion layer. Illustrative multi-layer photosensitive materials of this type are disclosed in British Pat. Nos. 774,655 and 1,021,564. They are effective for some limited purposes, but not effective under such conditions where a very bright image flares and cancels a darker image. To avoid this problem, a multi-layer photosensitive material that has high contrast for a dark image but low contrast for a bright image is desired. A product of this type is disclosed in Japanese Patent Publication No. 3843/74. However, none of these prior art products completely satisfy the requirement of high sharpness, high granularity or wide latitude for exposure, and a technique that meets these requirements simultaneously is yet to be developed.

SUMMARY OF THE INVENTION

A general object of the present invention is to provide a new multi-layer photosensitive material having wide latitude for exposure.

Another object of the invention is to provide a multi-layer photosensitive material having significantly improved sharpness and granularity.

These objects of the present invention can be achieved by a multilayer photosensitive material having formed on a support two or more layers that have different light sensitivities but have substantially the same color sensitivity wherein the layer having the highest light sensitivity contains only a compound of formula (I) as a DIR compound and at least one of the remaining layers contains at least one compound of formula (II) as a DIR compound:

$$A—TIME—Z \quad (I)$$

$$A—Z \quad (II)$$

wherein A is a coupling component capable of reaction with the oxidized product of a color developing agent to release the group TIME—Z (wherein TIME represents a timing group and Z represents a development retarder).

DETAILED DESCRIPTION OF THE INVENTION

The DIR compound of formula (I) may be of the type described in Japanese Patent O.P.I. Publication No. 145135/79 which releases the retarder by intramolecular nucleophilic substitution reaction or of the type described in Japanese Patent O.P.I. Publication No. 114946/81 which relies on electron transfer along a conjugated chain. The only requirement is that the compound first release the group TIME-Z by cleavage of A-TIME, then release Z by cleavage of TIME-Z. Suitable examples of Z are listed in Research Disclosure, 176, No.17643, December 1978 (hereunder referred to as Reference 1), and preferred examples include mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole and derivatives thereof.

More specifically, the DIR compound having the timing group according to the present invention has formula (III), (VI) or (VII). Formula (III) is:

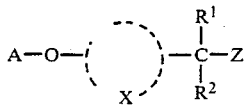

wherein A and Z are the same as defined in formula (I); X represents an atomic group necessary for completing a benzene ring or naphthalene ring; $R^1$ and $R^2$ each represents a hydrogen atom, an alkyl group or an aryl group; the group

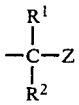

is substituted at ortho- or para-position with respect to the oxygen atom.

The compound of formula (III), when reacted with the oxidized product of a color developing agent, is first cleaved to form a compound of formula (IV), which is subsequently cleaved by electron transfer along a conjugated chain to form a compound of formula (V) and release Z:

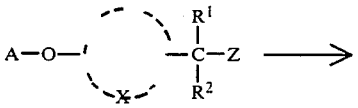

(III)

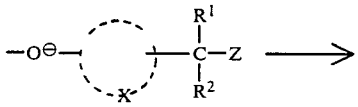

(IV)

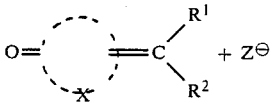

(V)

The compound having formula (V) is generally referred to as quinone methide or naphthoquinone methide.

For illustrative purposes, the mechanism of reaction between the oxidized product of a color developing agent and a DIR compound of formula (III) wherein a quinone methide forming compound is used as a timing group and phenyl mercaptotetrazole as Z is described by reference to the reaction scheme:

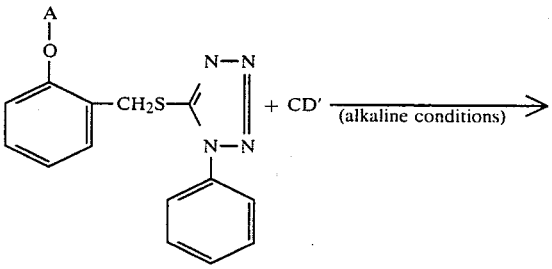

-continued

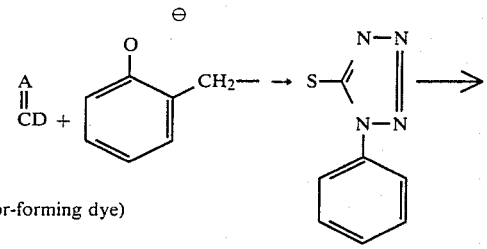

(color-forming dye)

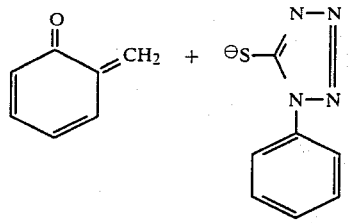

(orthoquinone methide) (restrainer)

In this reaction scheme, CD′ represents the oxided product of a color developing agent (this applies to the reaction schemes that follow) and A represents a color-forming coupler used in color photography. The timing group is bonded to a development retarder at a position where it is capable of reaction with the oxidized color developing agent. As shown above, the DIR compound with a timing group is cleaved upon reaction with CD′, and the timing group bonded to the retarder forms orthoquinone methide and releases the retarder by electron transfer along a conjugated chain as shown by the arrow.

Formula (VI) is:

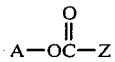

wherein A and Z are the same as defined in formula (I). The mechanism of Z release from this compound is described by reference to the following reaction scheme:

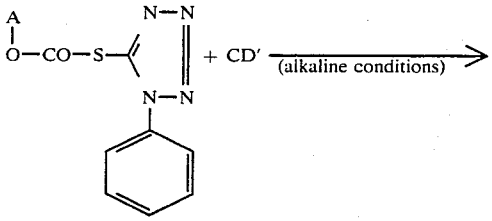

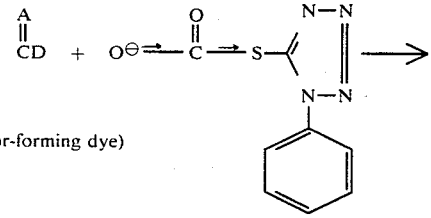

(color-forming dye)

-continued

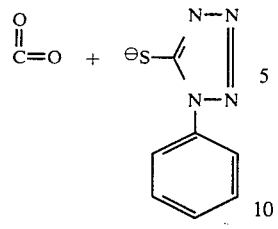

(development restrainer)

In this reaction scheme, A and CD′ have the same meaning as defined above, and an unpaired electron on the oxygen atom in a fragment cleaved upon reaction with CD′ is conjugated with Z electron in the carbonyl portion.

Formula (VII) represents an example of the DIR compound of the type that releases a retardant by intramolecular nucleophilic substitution, and it is:

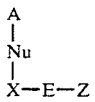

wherein A and Z are the same as defined in formula (I); Nu—X—E corresponds to TIME (wherein Nu is a nucleophilic group having an electron-rich oxygen, sulfur or nitrogen atom; E is an electrophilic group having an electron-poor carbonyl, thiocarbonyl, phosphinyl or thiophosphinyl group and is bonded to Z, and X which provides a steric relation between Nu and E is subjected to intramolecular nucleophilic substitution reaction after release of Nu from A to form a 3- to 7-membered ring, thereby releasing Z.

The mechanism of reaction between the oxidized product of a color developing agent and a DIR compound of formula (VII) wherein phenyl mercaptotetrazole is used as a retarder is described by reference to the following reaction scheme:

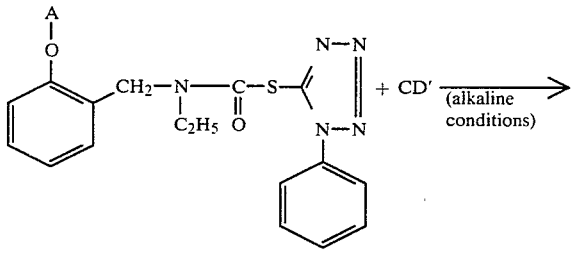

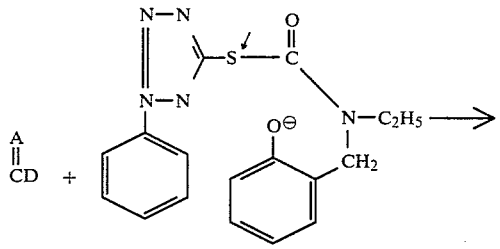

(color-forming dye)

-continued

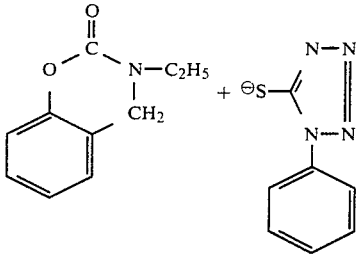

(development restrainer)

The DIR compound illustrated above is such that Nu, E and X in formula (VII) are oxygen, the group

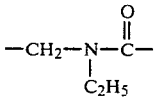

and phenylene group, respectively. As illustrated by the above reaction formulas, the DIR compounds having a timing group react with a color developing agent to be cleaved, and release a development retarder by intramolecular nucleophilic substitution reaction.

Z as in the formulas (I) and (II) of the present invention is preferably any of those represented by the following formula (VIII) or (IX):

Formula (VIII)

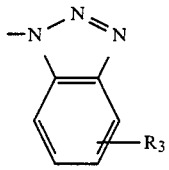

wherein $R_3$ is a halogen atom, an acylamino radical (such as an alkyl-acylamino radical having from 1 to 10 carbon atoms), a benzothiazolinylidenamino radical having the formula:

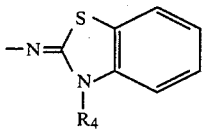

(wherein $R_4$ is an aryl radical or an alkyl radical having from 1 to 4 carbon atoms (and allowed to be substituted by, e.g., an alkoxy, a halogen, an aryl, etc.), or a phenyl-substituted alkoxy radical (such as benzyloxy, or the like).

Formula (IX)

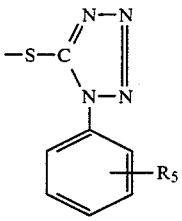

wherein $R_5$ is halogen, nitro, an alkoxy (such as an alkoxy having from 1 to 4 carbon atoms), an alkyl (such as an alkyl having from 1 to 4 carbon atoms), amino, an acylamino (such as an alkylacylamino having from 1 to 4 carbon atoms), hydroxy, carboxy, sulfo or sulfamoyl radical.

The DIR compounds with a timing group that can be used in the present invention are illustrated by the following nonlimiting examples:

T-1

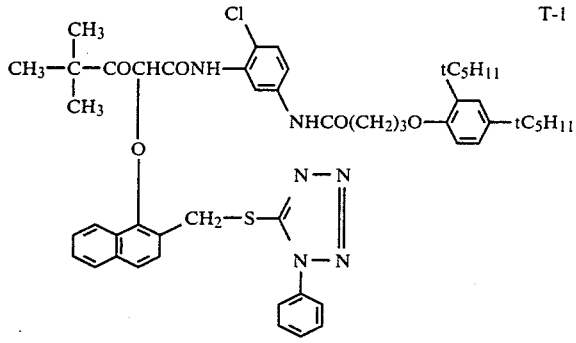

T-2

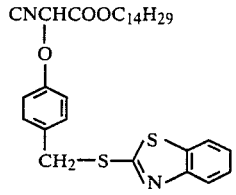

T-3

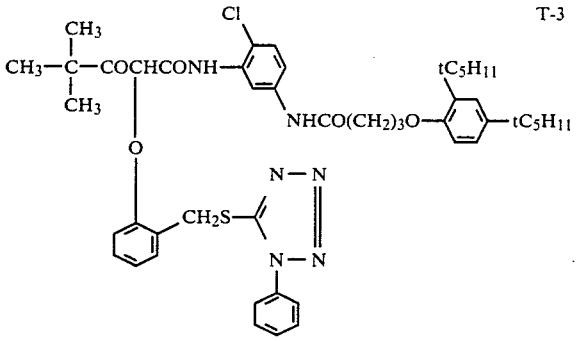

T-4

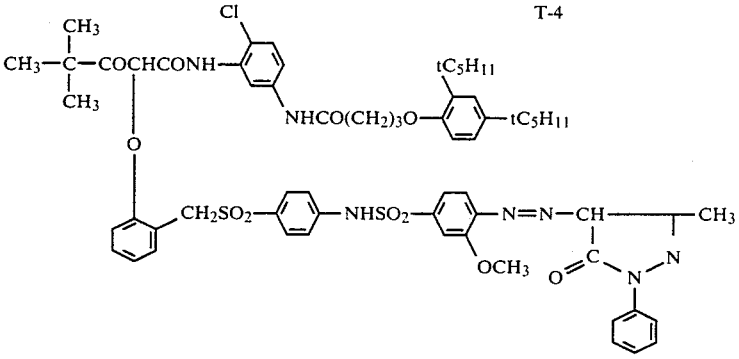

T-5

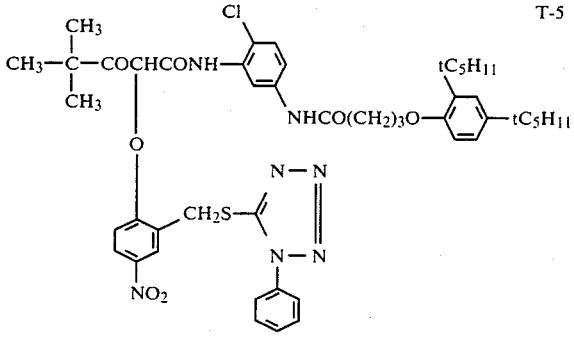

T-6

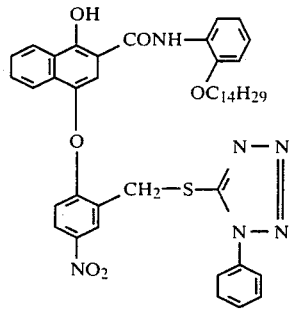

-continued
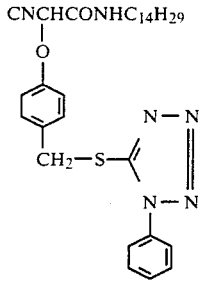
T-7
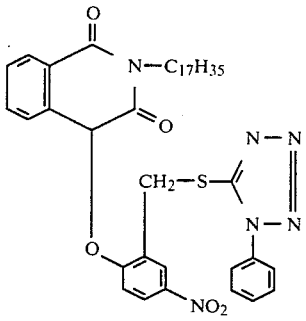
T-8
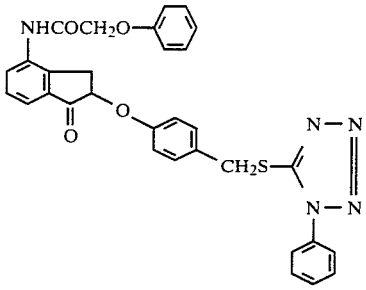
T-9
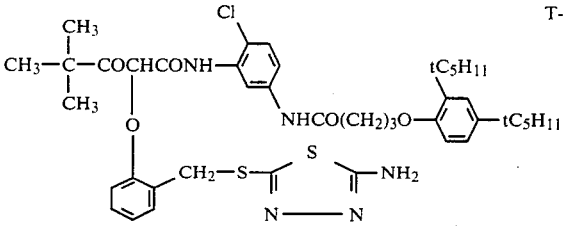
T-10
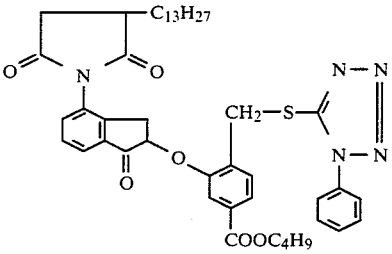
T-11
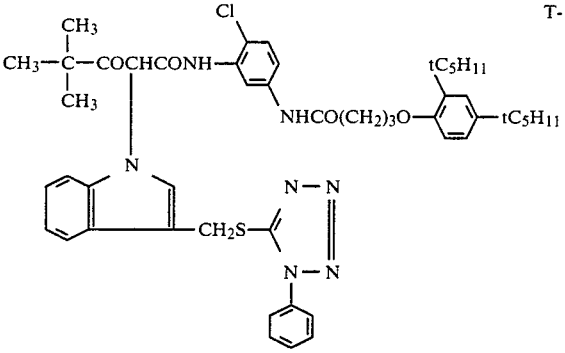
T-12
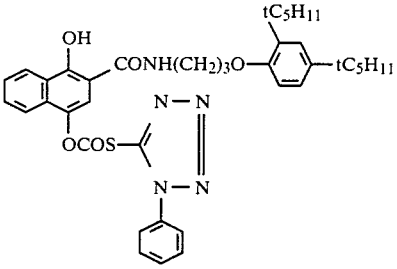
T-13
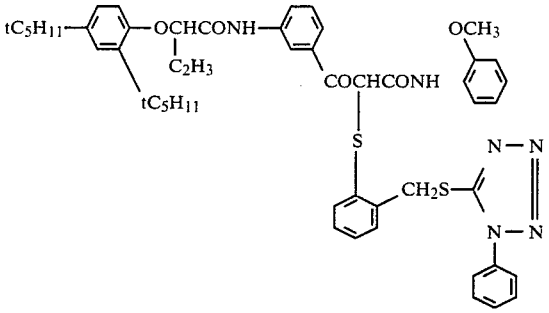
T-14
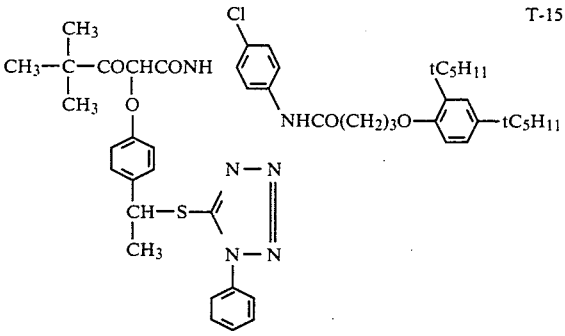
T-15
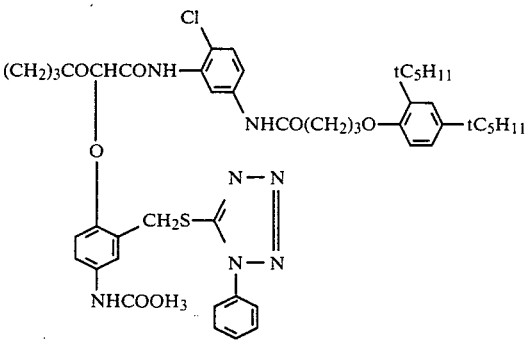
T-16

-continued
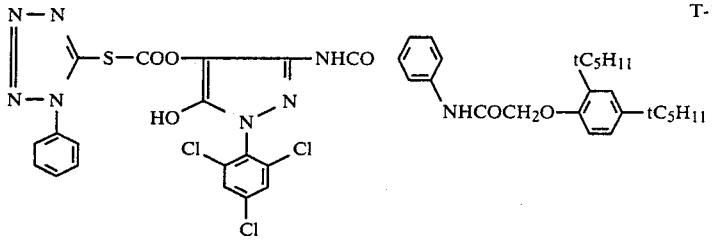
T-17
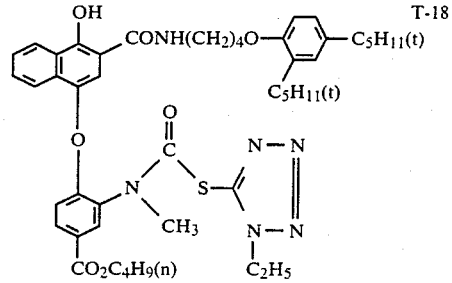
T-18
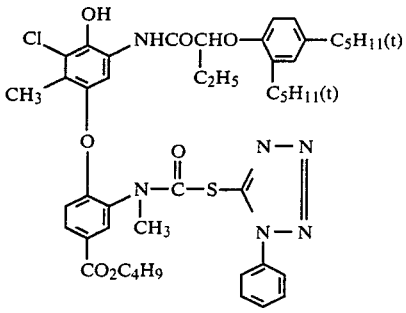
T-19
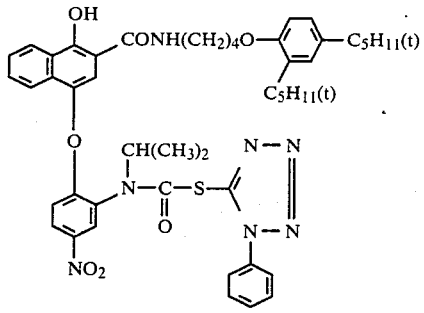
T-20
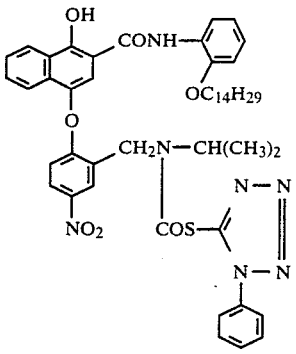
T-21
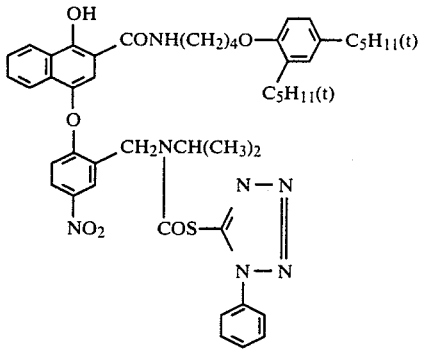
T-22
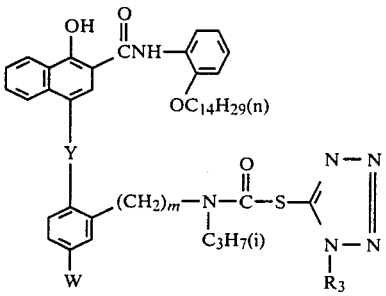
T-23 ~ T-30
The meanings of Y, W, m and $R^3$ in the respective compounds are listed below:
| Compound No. | Y | W | m | $R^3$ |
|---|---|---|---|---|
| T-23 | O | $NO_2$ | 0 | 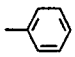 |
| T-24 | S | $NO_2$ | 1 | 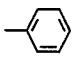 |
| T-25 | O | $NO_2$ | 1 | 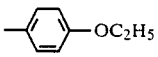 |
-continued
| | | | | |
|---|---|---|---|---|
| T-26 | O | $NO_2$ | 1 | 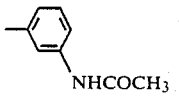 |
| T-27 | O | $NO_2$ | 1 | 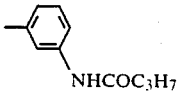 |
| T-28 | O | $NHSO_2C_4H_9$ | 0 | 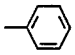 |
| T-29 | O | $NHSO_2C_8H_{17}$ | 1 | 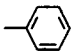 |

-continued

| | | | |
|---|---|---|---|
| T-30 | S | H | 0 |

T-31-T-35

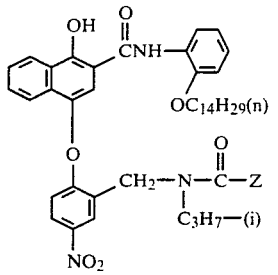

| Compound No. | Z |
|---|---|
| T-31 | ethyl thiomercaptotetrazole |
| T-32 | n-butyl thiomercaptotetrazole |
| T-33 | cyclohexyl thiomercaptotetrazole |
| T-34 | N—heptyl mercaptotetrazole |
| T-35 | 5,6-dichlorobenzotriazole |

T-36

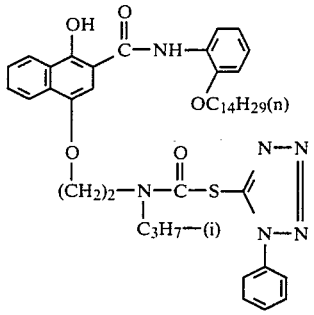

T-37

-continued

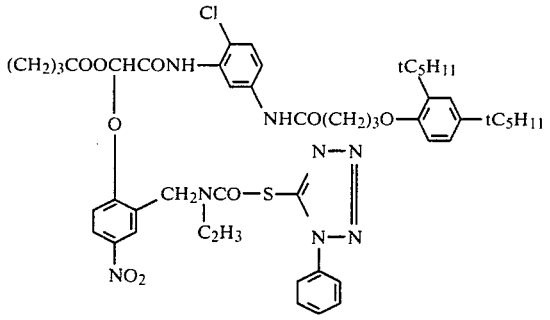

Syntheses of DIR compounds with a timing group that can be used in the present invention are described in the Japanese Patent O.P.I. Publication No. 145135/79, Japanese Patent O.P.I. Publication No. 114946/81 and the like.

DIR compounds without a timing group that have a component capable of coupling with the oxidized product of color developing agent and a group to become a retarder which is released upon coupling with the oxidized product of colour developing agent and which have no timing group between said component capable of coupling and said group to become retarder include DIR couplers and DIR materials.

Illustrative DIR couplers having no timing group are listed in U.S. Patents such as U.S. Pat. Nos. 3,227,554 and 3,773,201 and British Patent such as U.K. Pat. No. 2,010,818. Methods for synthesizing those couplers are also disclosed in these patents.

Illustrative DIR materials that have no timing group are disclosed in U.S. Pat. Nos. 3,958,993; 3,961,959; 3,938,996; 3,928,041 and 3,632,345; Japanese Patent O.P.I. Publication Nos. 147716/75; 152731/75; 105819/76; 6724/76; 46817/77 and 49030/77 and synthses of these materials are also disclosed in these patents and applications.

The DIR compounds having no timing group that can be used in the present invention are illustrated by the following nonlimiting examples:

D-1

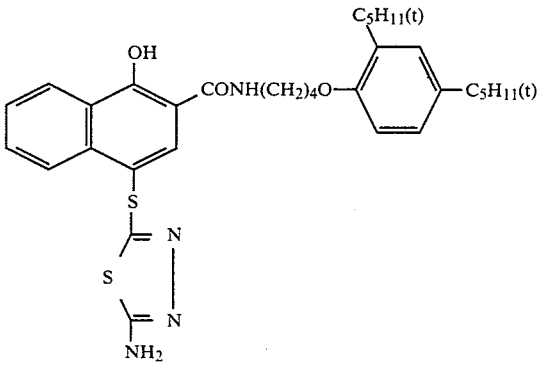

D-2

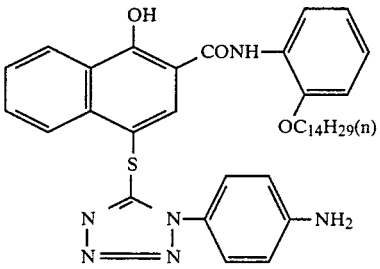

-continued
D-3
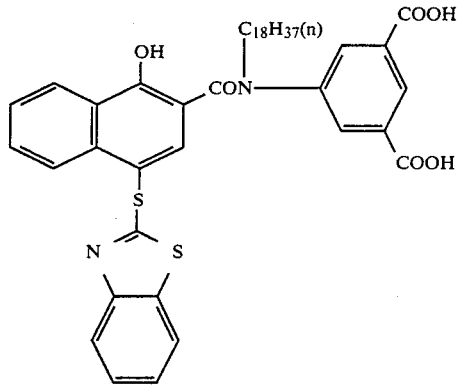
D-4
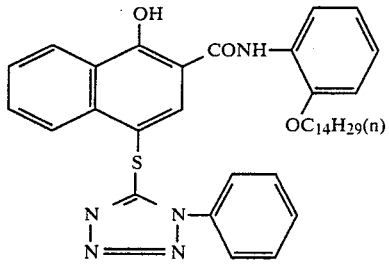
D-5
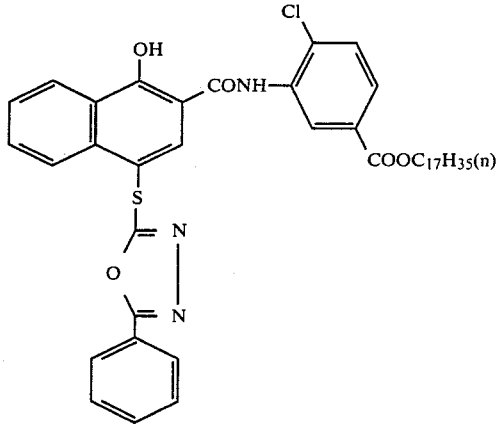
D-6
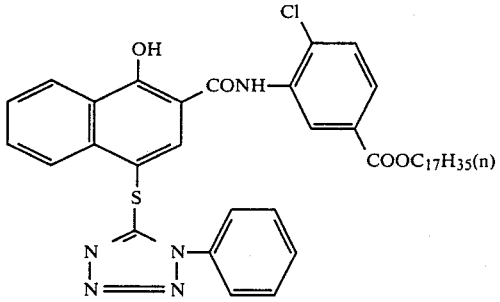
D-7
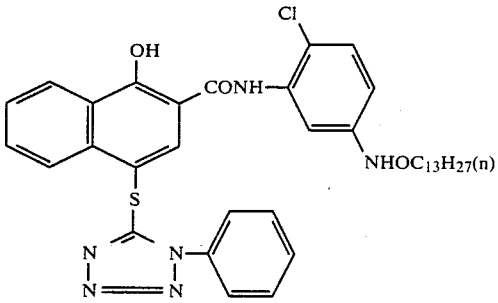
D-8
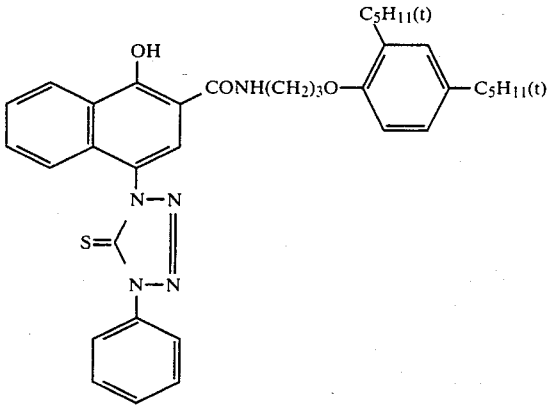
D-9
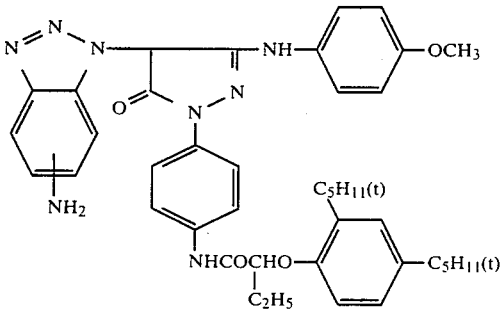
D-10
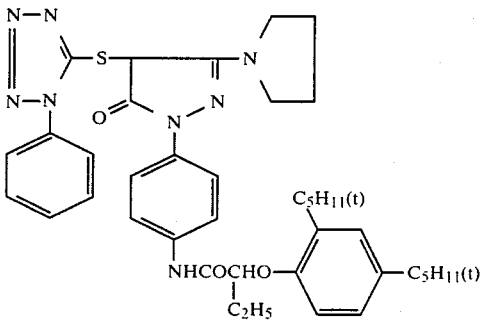

-continued
D-11
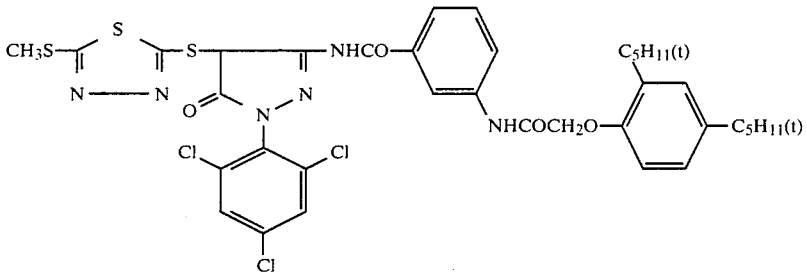
D-12
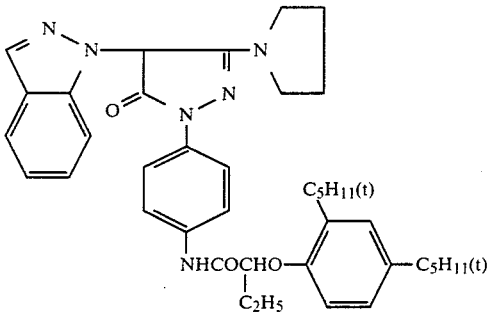
D-13
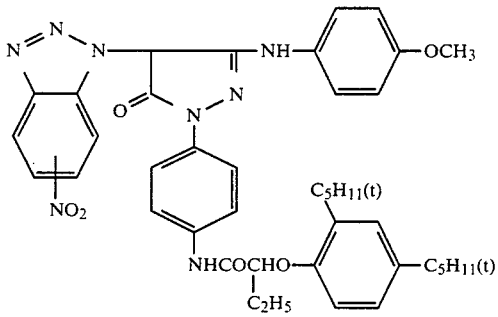
D-14
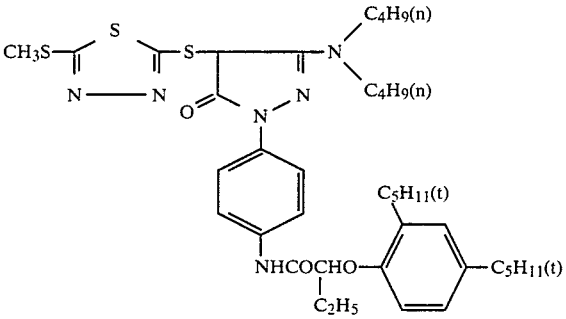
D-15
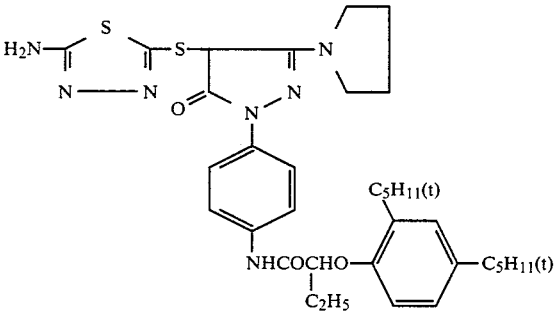
D-16
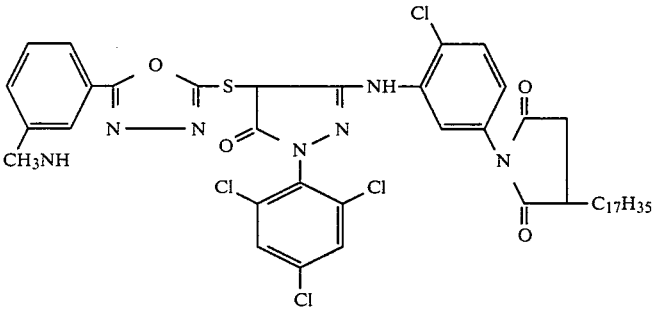

-continued
D-17
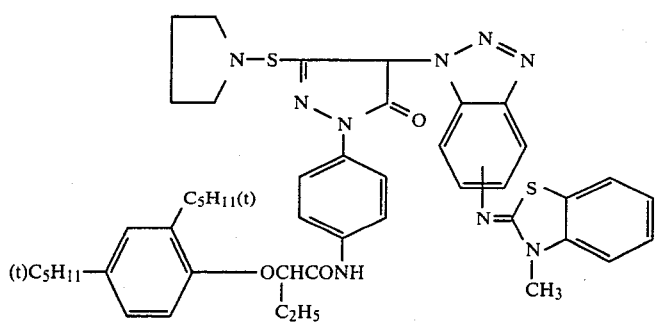
D-18
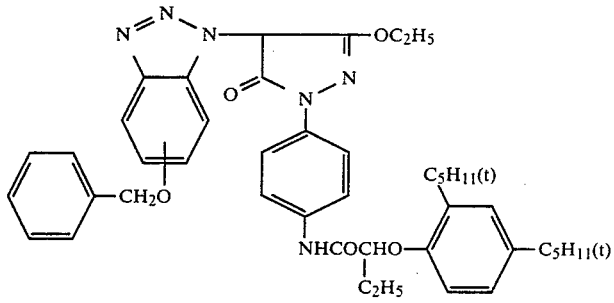
D-19
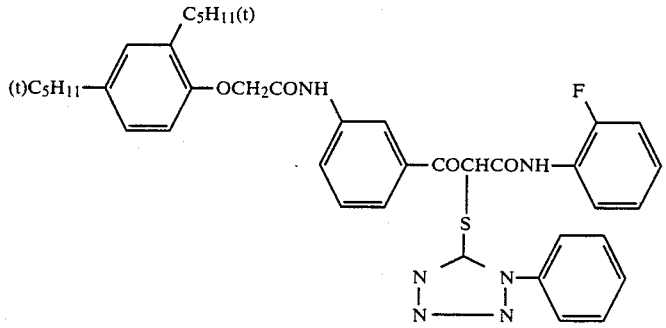
D-20
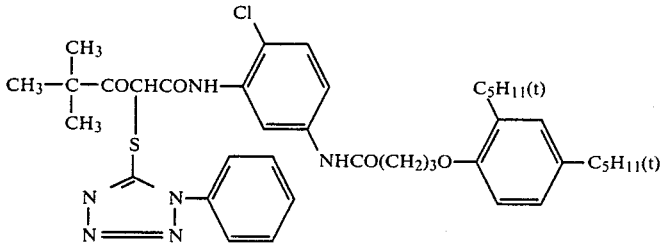
D-21
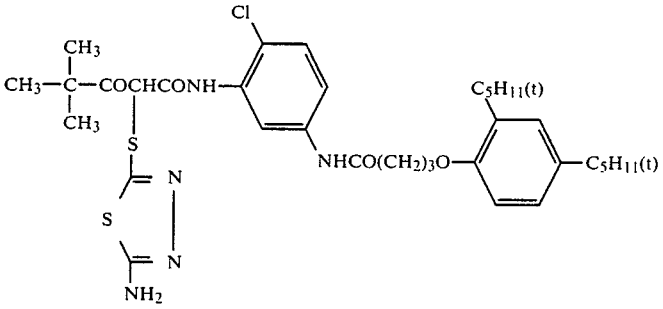

-continued
D-22
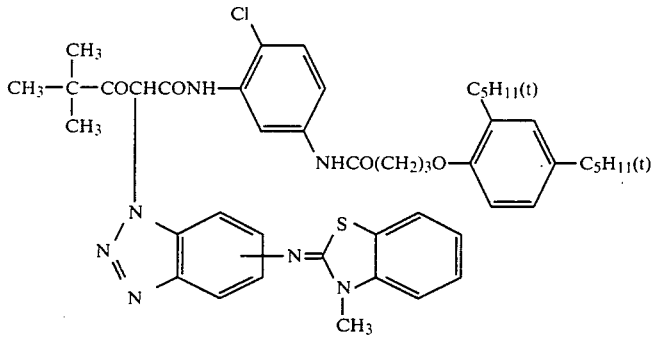
D-23
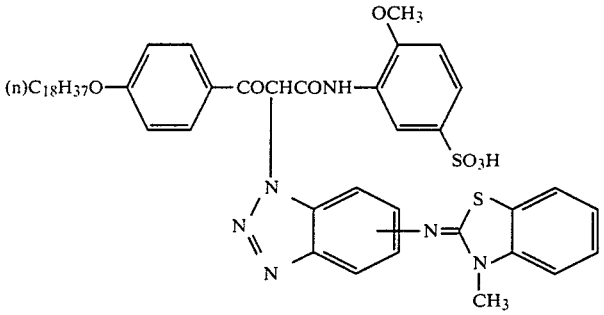
D-24
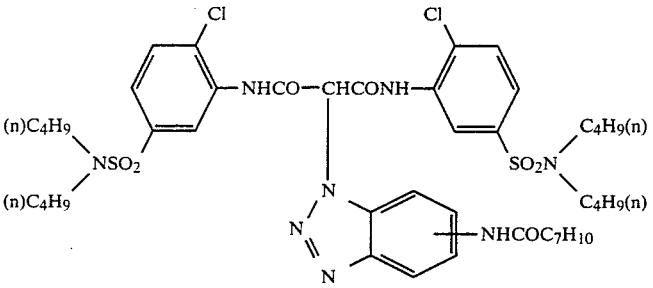
D-25
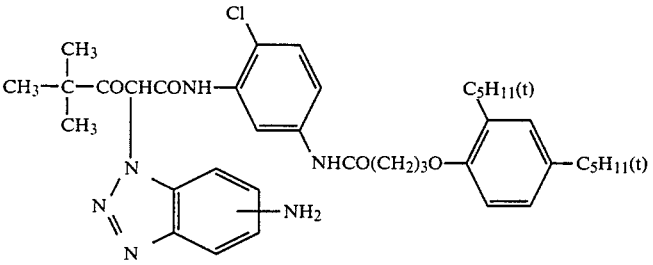
D-26
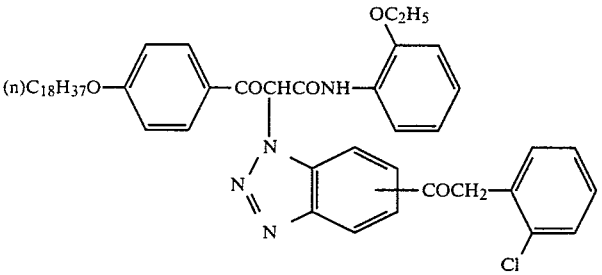

-continued
D-27
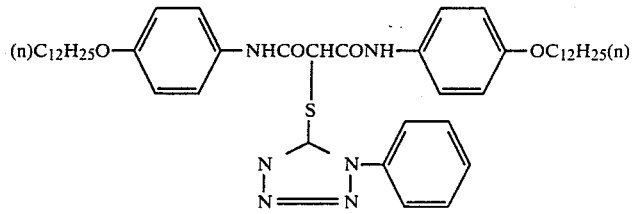
D-28
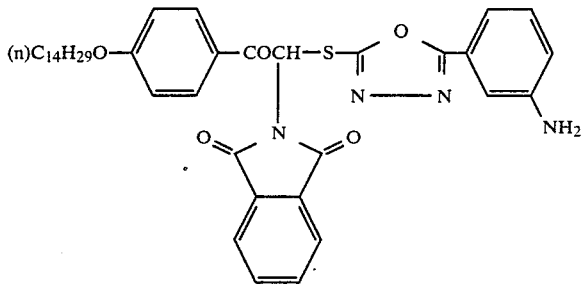
D-29
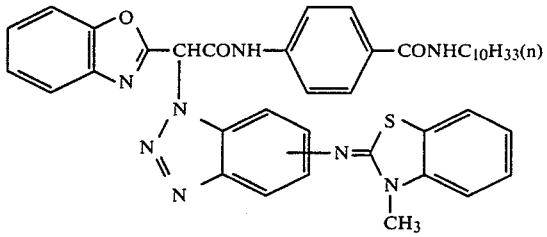
D-30
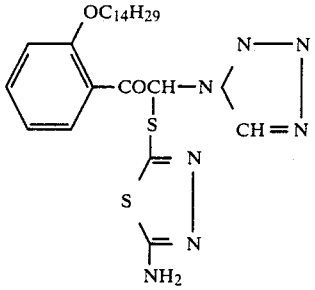
D-31
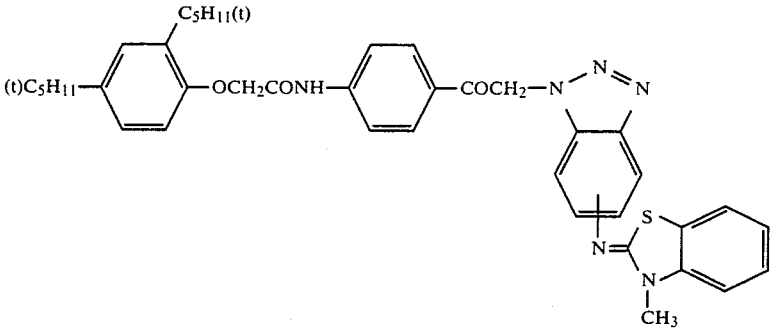
D-32
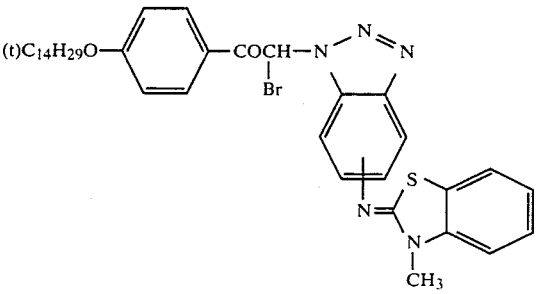

-continued
D-33
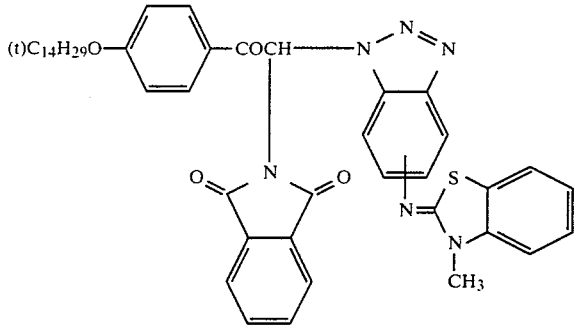
D-34
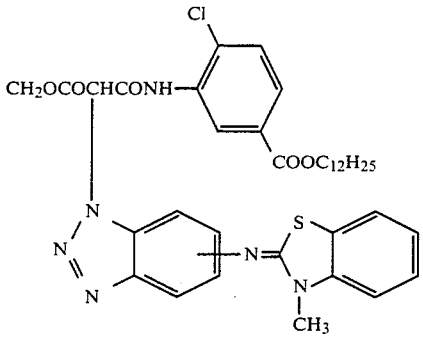
D-35
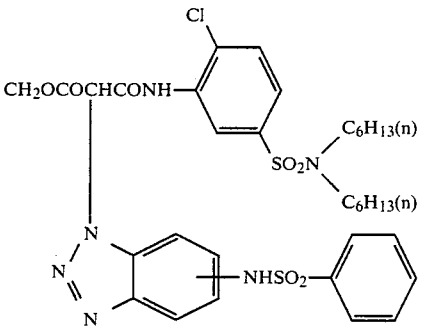
D-36
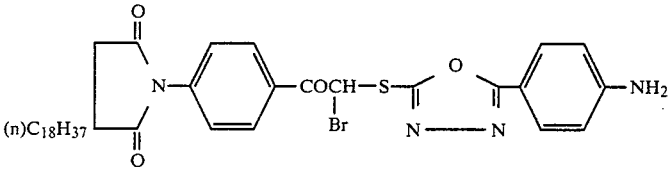
D-37
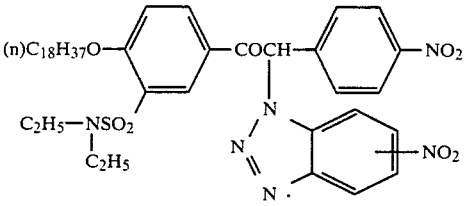
D-38
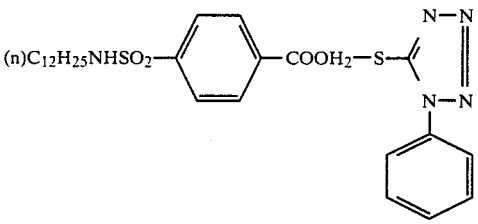
D-39
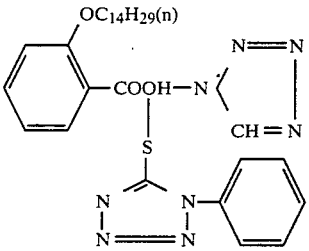
D-40
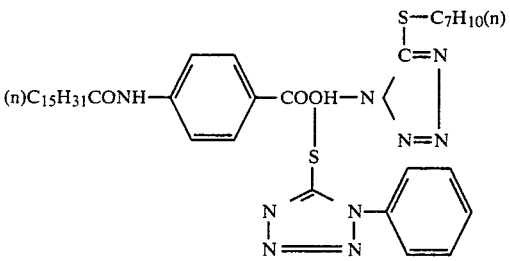
D-41
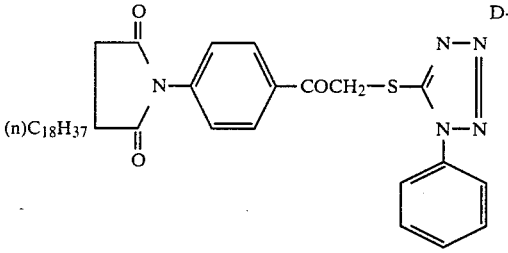
D-42
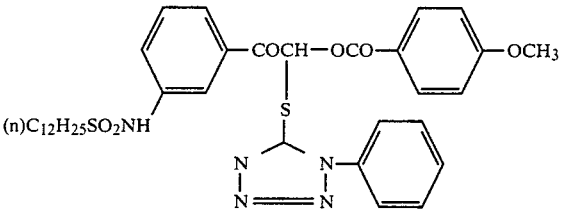

-continued
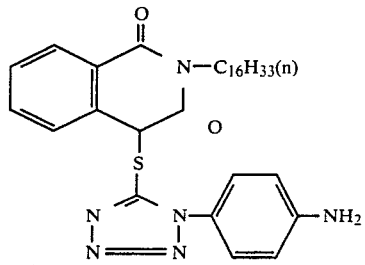
D-43
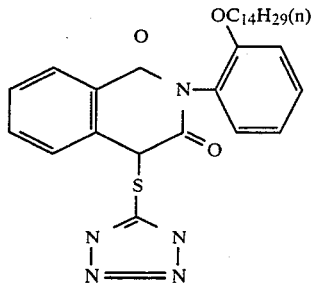
D-44
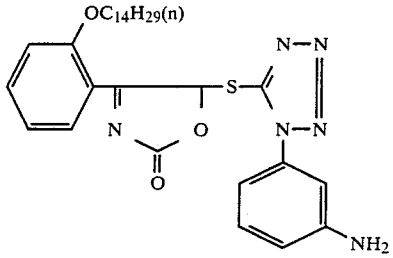
D-45
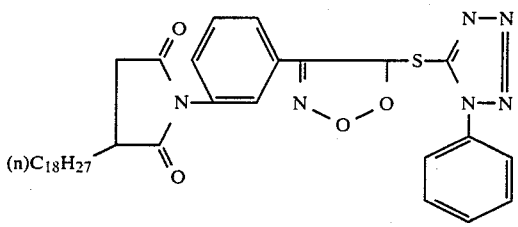
D-46
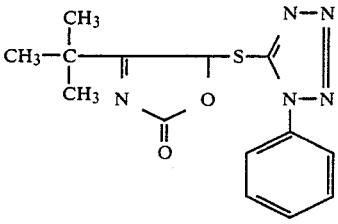
D-47
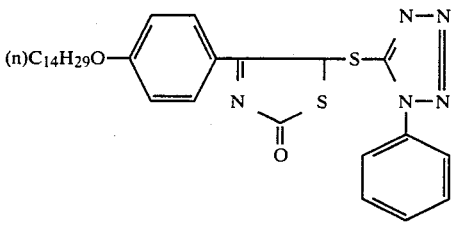
D-48
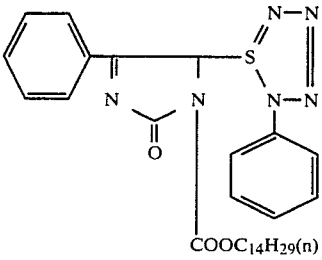
D-49
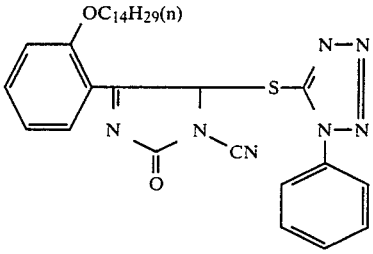
D-50
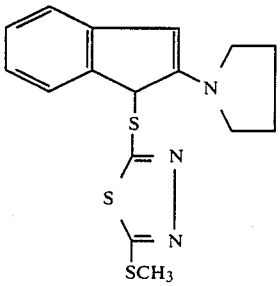
D-51
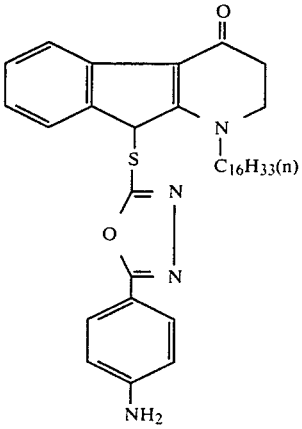
D-52

-continued
D-53
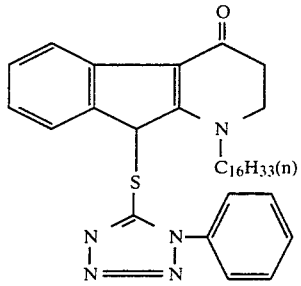
D-54
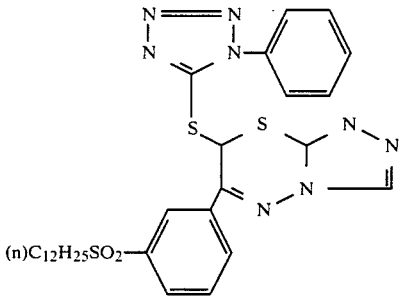
D-55
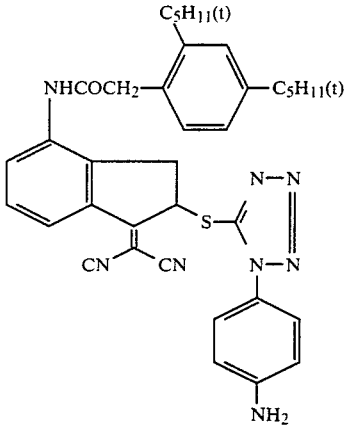
D-56
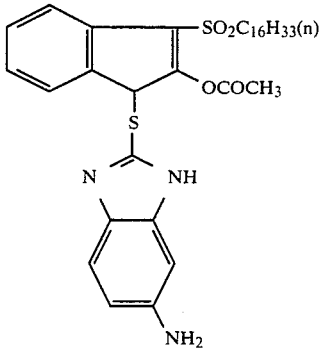
D-57
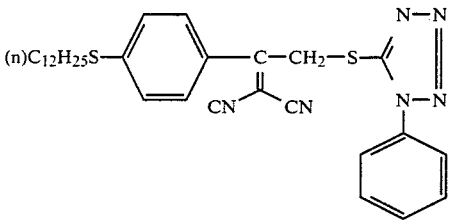
D-58
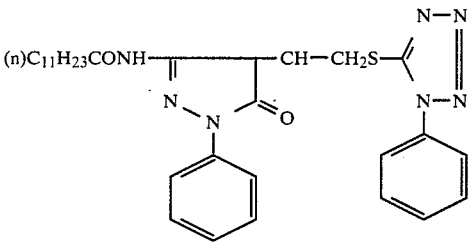
D-59
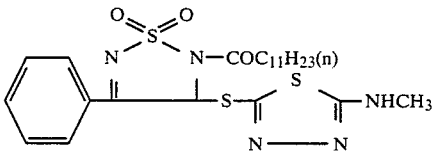
D-60
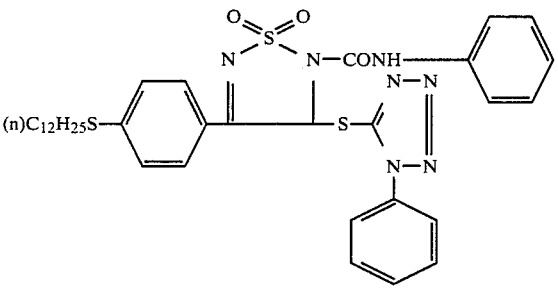
D-61
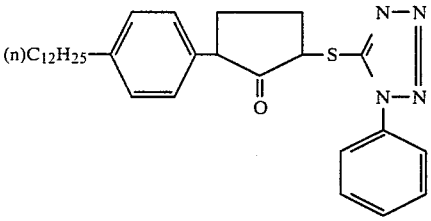
D-62
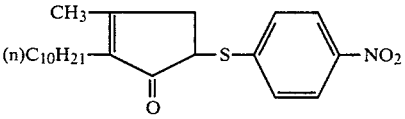

-continued
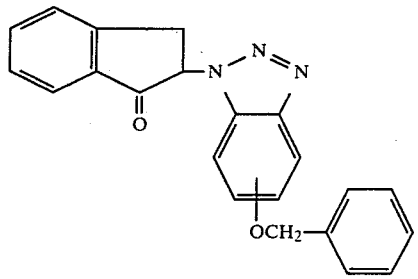
D-63
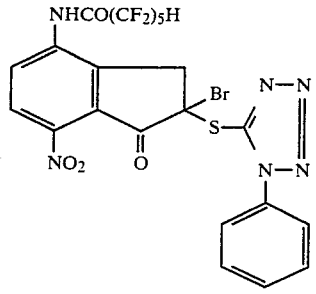
D-64
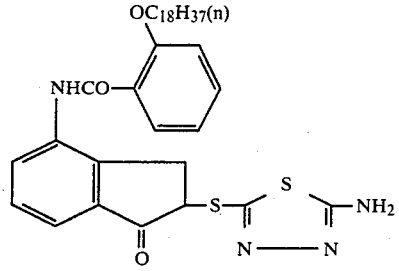
D-65
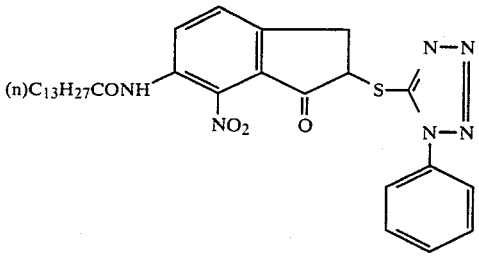
D-66
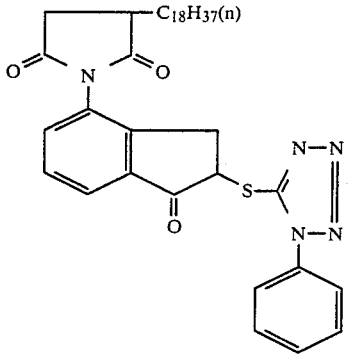
D-67
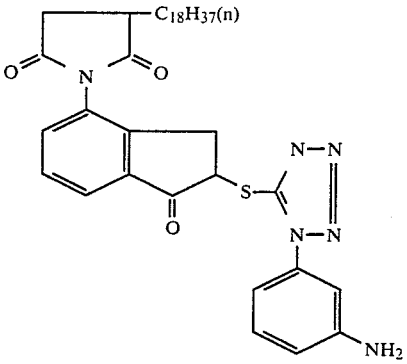
D-68
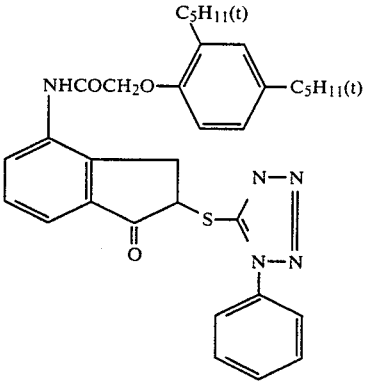
D-69
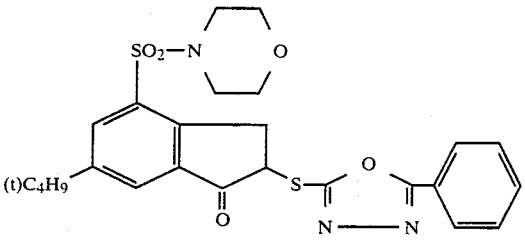
D-70
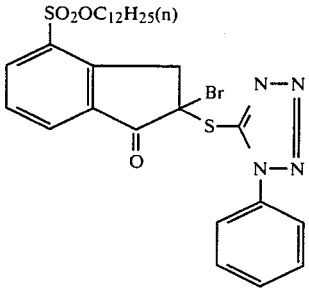
D-71
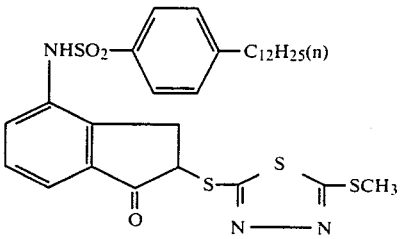
D-72

-continued
D-73
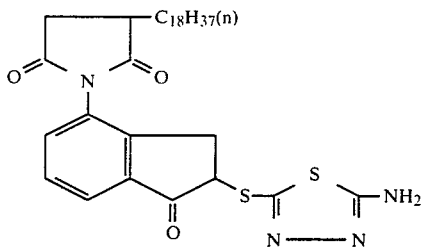
D-74
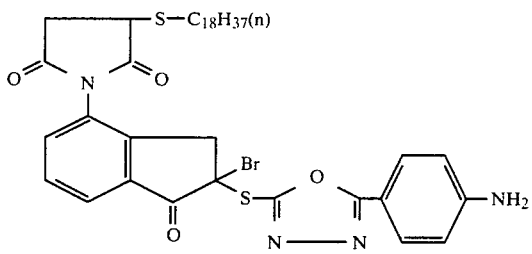
D-75
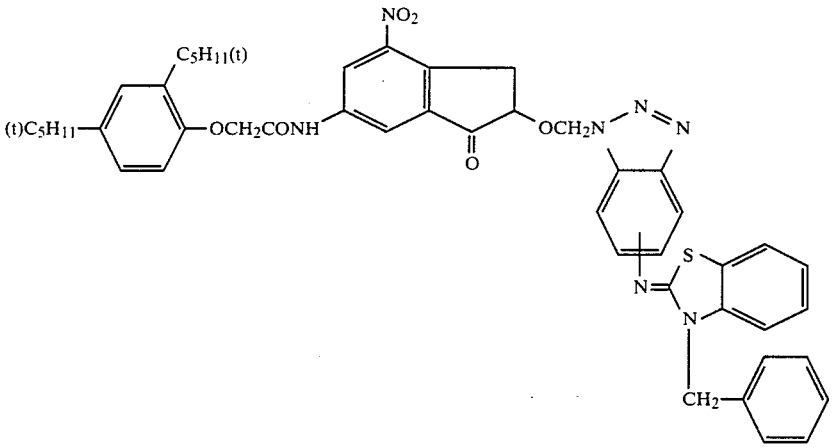
D-76
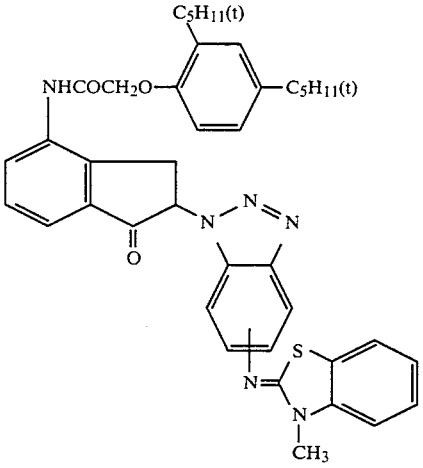
D-77
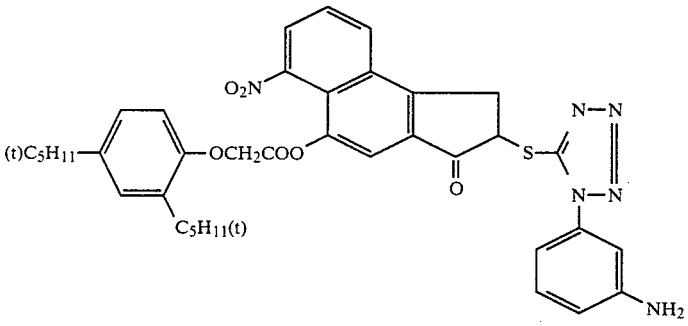

-continued
D-78
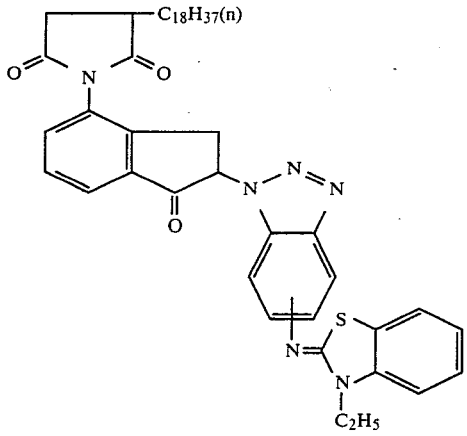
D-79
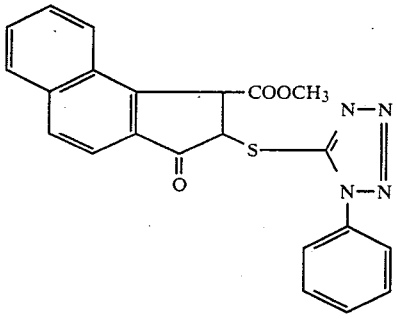
D-80
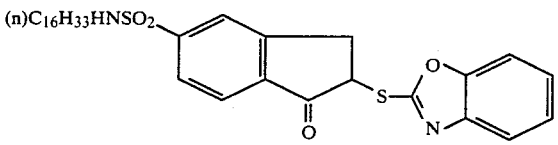
D-81
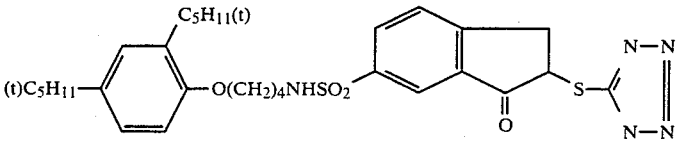
D-82
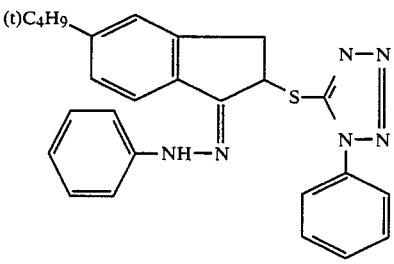
D-83
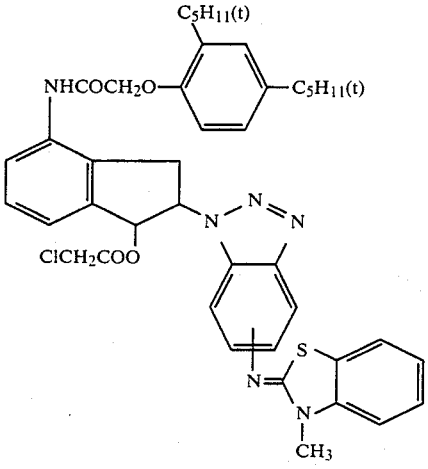
D-84
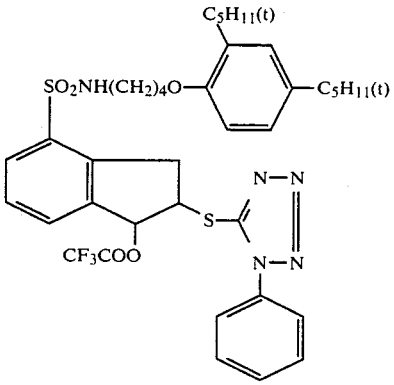
D-85
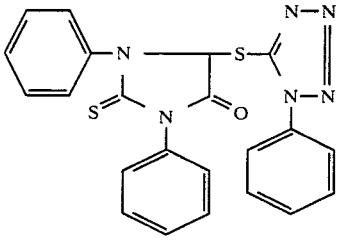

-continued

D-86

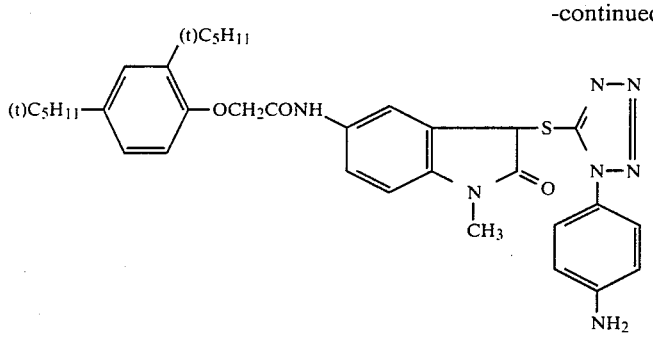

The DIR compound with a timing group according to the present invention is incorporated in a layer of the highest sensitivity in at least one of the three units of a three-color multilayer photosensitive material, i.e. a blue-sensitive layers' unit, a green-sensitive layers' unit and a red-sensitive layers' unit. One or more DIR compounds without a timing group according to the present invention are incorporated in at least one layer other than the layer of the highest sensitivity incorporating the DIR compound with a timing layer, and if desired, such layer may contain both types of DIR compound.

In the multi-layer photosensitive material of the present invention, the DIR compound with a timing group is incorporated in the layer of the highest sensitivity preferably in an amount of $1.0\times10^{-5}$ mol to $5.0\times10^{-1}$ mol, more preferably from $1.0\times10^{-4}$ mol to $1.0\times10^{-2}$ mol, per mol of the silver halide in the emulsion. The DIR compound with or without a timing group is incorporated in a layer other than the layer of the highest sensitivity preferably in an amount of $1.0\times10^{-4}$ mol to $5.0\times10^{-1}$ mol, more preferably from $1.0\times10^{-3}$ mol to $2.0\times10^{-2}$ mol, per mol of the silver halide in the emulsion.

In the multi-color photosensitive material of the present invention, each unit of emulsion layers preferably consists of two to four layers that are sensitive to substantially the same spectral region. In the present invention, any color developing agent that is conventionally used to develop silver halide photographic materials may be employed, and aromatic primary amines such as p-phenylenediamine and p-aminophenol of the type described in Reference 1 may be used. The multi-color photosensitive material of the present invention uses a coupler which is a compound that reacts with the oxidized developing agent to form a dye, and a nondiffusing coupler having a hydrophobic group (conventionally referred to as a ballast group) in the molecule is preferred. The coupler may be either four- or two-equivalent with respect to silver ion. The coupler may be of low-molecular weight type or high-molecular weight type called a polymeric coupler. The coupler may be combined with any of the known photosensitive emulsions.

The present invention is particularly advantageous for use in a multi-layer color photosensitive material, but it may also be used with good results in a multi-layer black-and-white photosensitive material that contains yellow, magenta and cyan couplers in layers having the same color sensitivity. The multi-layer photosensitive material of the present invention may contain a colored coupler for color correction.

Known open-ring ketomethylene couplers may be used as yellow couplers, and benzoyl acetanilide and pivaloyl acetanilide compounds are used with advantage. Suitable yellow couplers are listed in U.S. Pat. Nos. 2,875,057, 3,408,194, 3,551,155, 3,582,322, 3,894,875, German Patent Publication No. 1,547,868, and German Patent Applications (OLS) Nos. 2,213,461, 2,261,361, 2,263,875 and 2,414,006. As magenta couplers, 5-pyrazolone compounds are primarily used, and indazolone and cyanoacetyl compounds may also be used. Suitable magenta couplers are mentioned in U.S. Pat. Nos. 2,600,788, 3,062,653, 3,127,269, 3,311,476, 3,419,391, 3,519,429, 3,558,319, 3,582,322, 3,615,506, German Pat. No. 1,810,464, German Patent Applications (OLS) Nos. 2,408,665, 2,418,959, 2,424,467, and Japanese Patent Publications Nos. 6031/65 and 2016/69. As cyan couplers, phenol and naphthol derivatives are primarily used, and their specific examples are given in U.S. Pat. Nos. 2,369,929, 2,474,293, 2,521,908, 2,895,826, 3,034,892, 3,386,830, 3,458,315, 3,476,563, 3,583,971, 3,591,383, and Japanese Patent O.P.I. Publication No. 78905/73.

These couplers are generally used in an amount of $2\times10^{-3}$ mol to $5\times10^{-1}$ mol, preferably from $1\times10^{-2}$ mol to $5\times10^{-1}$ mol, per mol of the silver in an emulsion layer.

The DIR compound with a timing group and that having no timing group according to the present invention may be incorporated in the photosensitive layer by various methods, among which dispersion in a latex or water-in-oil emulsion is particularly effective. These techniques are well known, and details of the method of dispersing in a latex and its advantages are described in Japanese Patent O.P.I. Publication Nos. 74538/74, 59943/76 and 32552/79, as well as Research Disclosure, No. 14850, pp. 77–79, August 1976. Suitable latices include homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propanel-sulfonate, n-isopropylacrylamide, N-[2-(2-methyl-4-oxopentyl)]acrylamide, and 2-acrylamido-2-methylpropanesulfonic acid. Any known method of dispersing hydrophobic additives such as a coupler can be used to prepare a water-in-oil emulsion system. The two types of DIR compound according to the present invention may be dispersed simultaneously with other couplers, or they may be dispersed separately.

The silver halide emulsion for use in the photographic material of the present invention may be of any of the silver halide emulsions that are conventionally used in the art, such as silver chloride, silver bromide, silver iodobromide, silver chlorobromide, silver chloroiodide and chloroiodobromide crystals, as well as mixtures thereof. The silver halide emulsion may be made of large or small grains, and it may be of a mono- or polydisperse system. The silver halide crystals may be cubic, octahedral or mixed epitaxial crystals. The emulsion may be of negative type or direct positive type. It is a surface latent image type emulsion wherein a latent image is formed primarily on the surface of silver halide grains, an internal latent image type emulsion wherein the latent image is primarily formed in the interior of the silver halide grains, or it may be a mixture of the two types.

These silver halide grains may be chemically sensitized with active gelatin; sulfur sensitizers such as allyl thiocarbamide, thiourea and cystine; selenium sensitizers; reduction sensitizers such as stannous salts, thiourea dioxide and polyamines; noble metal sensitizers such as gold sensitizers (e.g. potassium aurithiocyanate, potassium chloroaurate and 2-aurosulfobenzothiazole methochloride) as well as water-soluble salts of ruthenium, rhodium and iridium (e.g. ammonium chloropalladate, potassium chloroplatinate and sodium chloropalladide, certain of which act as sensitizers or anti-foggants when they are used in suitable amounts). These sensitizers may be used either alone or in combination; for instance, a gold sensitizer is combined with a sulfur sensitizer or a selenium sensitizer.

The silver halide grains may also be optically sensitized to desired regions of wavelength by means of optical sensitizers such as cyanine and merocyanine dyes (e.g. ceromethine dyes, monomethine dyes, dimethine dyes and trimethine dyes). These dyes may be used alone or in combination with other sensitizers such as super-sensitizers.

For details of the construction of other parts of the silver halide photographic material of the present invention, see Reference 1 and Research Disclosure No. 18431.

The present invention is now described in greater detail by reference to the following examples which are given here for illustrative purposes only and are by no means intended to limit the scope of the invention.

EXAMPLE 1

A two-layer silver halide photographic material was prepared by coating a triacetate base with the following two layers.

First layer

Twenty-five grams of 1-hydroxy-N-[8-(2,4-di-t-amylphenoxy)butyl]-2-naphthamide (cyan coupler) and 2 g of disodium 1-hydroxy-4-[4-(1-hydroxy-8-acetamido-3,6-disulfo-2-naphthylazo)phenoxy]-N-[8-(2,4-di-t-amylphenoxy)butyl]-2-naphtamide (colored coupler) were dissolved in a mixture of tricresyl phosphate (28 g) and ehtyl acetate (55 ml) under heating. The resulting solution was added to 200 ml of a 7.5% aqueous gelatin solution containing 2 g of sodium triisopropyl naphthalenesulfonate, and the mixture was agitated with a colloid mill to prepare a dispersion. The dispersion was added to 1 kg of a low red-sensitive silver iodobromide emulsion (containing 4 mol% of silver iodide and having an average grain size of 0.7μ), and the mixture was applied to the base in a dry thickness of 2.0μ.

Second layer

Five grams of 1-hydroxy-4-[β-methoxyethylaminocarbonyl]-methoxy)-N-[8-(2,4-di-t-amylphenoxy)butyl]-2-naphthamide and 0.2 g of the same colored coupler as used in the first layer were dissolved in a mixture of tricresyl phosphate (10 g) and ethyl acetate (25 ml) under heating. The resulting solution was added to 200 ml of a 7.5% aqueous gelatin solution containing 1 g of sodium triisopropyl naphthalenesulfonate, and the mixture was agitated with a colloid mill to prepare a dispersion. The dispersion was added to 1 kg of a highly red-sensitive silver iodobromide emulsion (containing 7 mol% of silver iodide and having an average grain size of 1.2μ), and the mixture was applied to the first layer in a dry thickness of 2.0μ. The sample was referred to as Sample No. 1. Six other samples were prepared as above except that they contained.

DIR compounds (see Table 1 below) in the respective emulsions.

Seven samples were exposed through an optical wedge, developed with a color developer of the formulation indicated below at 38° C. for 3 minutes, bleached, fixed and washed with water.

| Color developer | |
|---|---|
| 4-amino-3-methyl-N—ethyl-N—(β-hydroxyethyl)-aniline sulfate | 4.75 g |
| anhydrous sodium sulfite | 4.25 g |
| hydroxylamine hemisulfate | 2.0 g |
| anhydrous potassium carbonate | 37.5 g |
| sodium bromide | 1.3 g |
| trisodium nitrilotriacetate (monohydrate) | 2.5 g |
| potassium hydroxide | 1.0 g |
| water to make | 1000 ml |

pH adjusted to 10.0 with potassium hydroxide

The results are shown in Table 1 below. The image sharpness was evaluated by comparing the magnitude of modulation transfer function (MTF) for a spatial frequency of 10 cycles/mm and that for 30 cycles/mm. The R.M.S. granularity was evaluated by comparing the values 1000 times the standard difference of density variations resulting from scanning with a microdensitometer having a circular scanning aperture of 25μ. The latitude for exposure was expressed in terms of the exposure region (logE) in the straightline portion of the characteristic curve, with the control (Sample No. 1) taken as 100.

TABLE 1

| | DIR COMPOUND | | | MTF | | | |
|---|---|---|---|---|---|---|---|
| Sample No. | high-sensitivity layer | low-sensitivity layer | latitude | 10 c./mm | 30 c./mm | RMS | Remarks |
| 1. | — | — | 100 | 97 | 59 | 91 | comparative sample |
| 2. | D-64(0.1) | D-64(0.2) | 115 | 105 | 72 | 65 | comparative sample |
| 3. | T-37(0.05) | T-37(0.1) | 114 | 113 | 77 | 76 | comparative sample |
| 4. | D-64(0.1 ) | T-37(0.05) T-37(0.05) | 118 | 105 | 78 | 77 | comparative sample |
| 5. | D-64(0.1) | T-37(0.1) | 117 | 100 | 63 | 65 | comparative sample |
| 6. | T37(0.05) | D-64(0.2) | 122 | 129 | 86 | 60 | sample of the present invention |
| 7. | T37(0.05) | D-64(0.1) T-37(0.05) | 121 | 134 | 89 | 62 | sample of the present invention |

Note: The figures in parentheses indicate the amounts of the DIR compounds added (100 × mol/mol Ag)

Table 1 shows that although all samples but No. 1 had substantially the same latitude for exposure, samples Nos. 6 and 7 according to the present invention had improved sharpness and granularity.

EXAMPLE 2

Seven samples Nos. 8 to 14 were prepared as in Example 1 except that the cyan coupler was replaced by a magenta coupler, 1-(2,4,6-trichlorophenyl)-3-[3-(2,4-di-t-amylphenoxyacetamido)benzamido]-5-pyrazolone and the colored cyan coupler by a colored magenta coupler, 1-(2,4,6-trichlorophenyl)-4-(1-naphthylazo)-3-(2-chloro-5-octadecenylsuccinimidoanilino)-5-pyrazolone, and the red-sensitive emulsion by a green-sensitive emulsion. The samples were processed as in Example 1, and the results are shown in Table 2.

TABLE 2

| Sample No. | DIR COMPOUND high-sensitivity layer | DIR COMPOUND low-sensitivity layer | latitude | MTF 10 c./mm | MTF 30 c./mm | RMS | Remarks |
|---|---|---|---|---|---|---|---|
| 8. | — | — | 100 | 92 | 50 | 90 | comparative sample |
| 9. | D-76(0.1) | D-67(0.2) | 118 | 100 | 71 | 64 | comparative sample |
| 10. | D-4(0.1) | D-67(0.2) | 118 | 111 | 75 | 73 | comparative sample |
| 11. | T-36(0.05) | T-36(0.1) | 120 | 104 | 73 | 73 | comparative sample |
| 12. | D-67(0.1) | T-36(0.1) | 115 | 99 | 66 | 63 | comparative sample |
| 13. | T-36(0.05) | D-67(0.2) | 123 | 120 | 85 | 58 | sample of the present invention |
| 14. | T-36(0.05) | D-4(0.2) | 125 | 131 | 88 | 59 | sample of the present invention |

The table shows that samples Nos. 13 and 14 of the present invention had improved sharpness and granularity.

EXAMPLE 3

Four samples Nos. 15 to 18 were prepared as in Example 1 except that the cyan coupler was replaced by α-pivaloyl-5-[γ-(2,4-di-t-amylphenoxy)-butylamido]-2-chloroacetanilide (yellow coupler), the colored cyan coupler was omitted and the red-sensitive emulsion replaced by a blue-sensitive emulsion. The samples were processed as in Example 1, and the results are shown in Table 3.

TABLE 3

| Sample No. | DIR COMPOUND high-sensitivity layer | DIR COMPOUND low-sensitivity layer | latitude | MTF 10 c./mm | MTF 30 c./mm | RMS | Remarks |
|---|---|---|---|---|---|---|---|
| 15. | — | — | 100 | 109 | 76 | 79 | comparative sample |
| 16. | D-69(0.1) | D-69(0.2) | 120 | 112 | 79 | 71 | comparative sample |
| 17. | T-3(0.05) | D-69(0.2) | 127 | 133 | 89 | 63 | sample of the present |

TABLE 3-continued

| Sample No. | DIR COMPOUND high-sensitivity layer | DIR COMPOUND low-sensitivity layer | latitude | MTF 10 c./mm | MTF 30 c./mm | RMS | Remarks |
|---|---|---|---|---|---|---|---|
| 18. | T-3(0.05) | D-4(0.2) | 126 | 124 | 85 | 61 | invention sample of the present invention |

The data shows that samples Nos. 17 and 18 of the present invention had improved sharpness and granularity.

What is claimed is:

1. A silver halide photographic material comprising a support and two or more light-sensitive layers provided thereon that are sensitive to substantially the same spectral region and have different light sensitivities, wherein the light-sensitive layer having the highest light sensitivity contains only a compound of formula (I) and at least one of the remaining layers contains at least one compound of formula (II):

A—TIME—Z (I)

A—Z (II)

wherein A is a coupling component capable of reaction with the oxidized product of a color developing agent to release the group TIME—Z (wherein TIME represents a timing group and Z represents a development inhibitor).

2. A silver halide photographic material according to claim 1, wherein said compound of formula (I) is a compound represented by the following formula (III), (VI) or (VII);

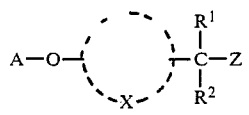

(III)

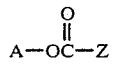

(VI)

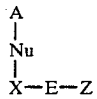

(VII)

wherein A and Z are the same as defined in formula (I); X represents an atomic group necessary for completing a benzene ring or naphthalene ring; $R^1$ and $R^2$ each represents a hydrogen atom, an alkyl group or an aryl group; and Nu-X-E corresponds to TIME defined in formula (I), wherein Nu is a nucleophilic group having an electron-rich oxygen, sulfur or nitrogen atom; E is an electrophilic group having an electron-poor carbonyl, thiocarbonyl, phosphinyl or thiophosphinyl group and is bonded to Z; and X which provides a steric relation between Nu and E is subjected to intramolecular nucleophilic substitution reaction after release of Nu from A to form a 3- to 7-membered ring, thereby releasing Z.

3. A silver halide photographic material according to claim 1, wherein Z in the formulas (I) and (II) is represented by the following formula (VIII) or (IX):

Formula (VIII)

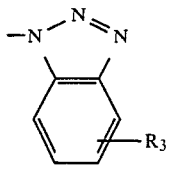

wherein $R_3$ is a halogen atom, an acylamino radical, a benzothiazolinylideneamino radical having the formula:

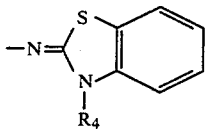

(wherein $R_4$ is an aryl radical or an alkyl radical having from 1 to 4 carbon atoms), or a phenyl-substituted alkoxy radical; or Formula (IX)

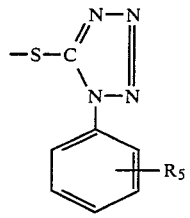

wherein $R_5$ is halogen, nitro, an alkoxy, an alkyl, amino, acylamino, hydroxy, carboxy, sulfo or sulfamoyl radical.

4. A silver halide photographic material according to claim 1, wherein said compound of formula (I) is contained in the layer having the heighest light sensitivity in an amount of $1.0\times10^{-5}$ mol to $5.0\times10^{-1}$ mol per mol of the silver halide.

5. A silver halide photographic material according to claim 1, wherein said compound of formula (I) is contained in the layer having the highest light sensitivity in an amount of $1.0\times10^{-4}$ mol to $1.0\times10^{-2}$ mol per mol of the silver halide.

6. A silver halide photographic material according to claim 1, wherein said at least one compound of formula (II) is contained in at least one layer other than the layer having the highest light sensitivity in an amount of 1.0 to $10^{-4}$ mol to $5.0\times10^{-1}$ mol per mol of the silver halide.

7. A silver halide photographic material according to claim 1, wherein said compound of formula (II) is contained in at least one layer other than the layer having the highest light sensitivity in an amount of $1.0\times10^{-3}$ mol to $2.0\times10^{-2}$ mol per mol of the silver halide.

8. A silver halide photographic material according to claim 1, wherein said two or more light-sensitive layers are blue-sensitive, green-sensitive or red-sensitive layers.

* * * * *